US005862785A

United States Patent [19]

Blowers et al.

[11] Patent Number: 5,862,785

[45] Date of Patent: Jan. 26, 1999

[54] HYDRAULIC LASH ADJUSTER AND IMPROVED OIL FLOW PATH THEREFOR

[75] Inventors: Bryan K. Blowers; Thomas C. Edelmayer, both of Battle Creek; George A. Hillebrand, Hickory Corners, all of Mich.

[73] Assignee: Eaton Corporation, Cleveland, Ohio

[21] Appl. No.: 13,143

[22] Filed: Jan. 26, 1998

[51] Int. Cl.[6] ..... F01L 1/24

[52] U.S. Cl. ..... 123/90.43; 123/90.36; 123/90.55

[58] Field of Search ..... 123/90.33, 90.35, 123/90.36, 90.39, 90.41, 90.43, 90.48, 90.49, 90.55, 90.57

[56] References Cited

U.S. PATENT DOCUMENTS

| | | | |
|---|---|---|---|
| 3,875,908 | 4/1975 | Ayres | 123/90.36 |
| 4,098,240 | 7/1978 | Abell, Jr. | 123/90.43 |
| 4,917,059 | 4/1990 | Umeda | 123/90.43 |
| 5,509,385 | 4/1996 | La Vieri | 123/90.43 |
| 5,622,147 | 4/1997 | Edelmayer | 123/90.35 |

*Primary Examiner*—Weilun Lo
*Attorney, Agent, or Firm*—L. J. Kasper

[57] ABSTRACT

A hydraulic lash adjuster having a body (11) defining a blind bore (13) and a fluid port (35) in communication with a source of fluid pressure. Upper and lower plunger elements (17,19) are disposed within the body and define a low pressure fluid chamber (21). The upper end portion (53) of the lower plunger element (19) defines a series of openings (55) providing fluid communication from the bore (13) into the chamber (21). The bore (13) and the upper plunger element (17) define a radial clearance sufficient that the clearance and the openings (55) comprise substantially the only fluid path from the fluid port (35) to the chamber (21). The invention reduces the machining of the body (11) and the upper plunger (17) which are normally required, thus substantially reducing the cost of the lash adjuster.

5 Claims, 1 Drawing Sheet

HYDRAULIC LASH ADJUSTER AND IMPROVED OIL FLOW PATH THEREFOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates generally to hydraulic lash adjusters, and more particularly to a hydraulic lash adjuster (HLA) of the type in which there is both a high pressure chamber and a reservoir, or low pressure chamber.

Hydraulic lash adjusters (also sometimes referred to as "lifters") for internal combustion engines have been in use for many years to eliminate clearance, or lash, between engine valve train components under varying operating conditions, in order to maintain efficiency and to reduce noise and wear in the valve train. Hydraulic lash adjusters operate on the principle of transmitting the energy of the valve actuating cam through hydraulic fluid, trapped in a pressure chamber under a plunger. During each operation of the cam, as the length of the valve actuating components varies as a result of temperature changes and wear, small quantities of hydraulic fluid are permitted to enter the pressure chamber, or escape therefrom, thus effecting an adjustment in the position of the plunger, and consequently adjusting the effective total length of the valve train.

The cam operating cycle comprises two distinct events: (1) operation on the base circle and (2) valve actuation. The base circle event is characterized by a constant radius between the cam center of rotation and the cam follower, and during this event, no cam energy is transmitted. The valve actuation event is characterized by a varying radius between the cam center of rotation and the cam follower, which effectively transmits cam energy to open and close an engine valve. During the valve actuation event, a portion of the load resulting from the valve spring, the inertia of valve train components, and cylinder pressure are transmitted through the valve train and through the lash adjuster. The load increases the pressure of the hydraulic fluid within the lash adjuster pressure chamber, in proportion to the plunger area, and in typical hydraulic lash adjusters currently in commercial production, fluid escapes the pressure chamber between the plunger and the wall of the lash adjuster body. Such a device is referred to as a "conventional leakdown" lash adjuster.

As the fluid escapes, the volume of the pressure chamber is decreased and the plunger moves down, shortening the effective length of the lash adjuster. During the base circle event, the lash adjuster plunger spring moves the plunger up within the body such that no clearance or lash exists between valve actuation components. As this occurs, hydraulic fluid is drawn into the pressure chamber through the plunger check valve in response to the increasing volume of the pressure chamber as the plunger moves up. If the effective length of the valve train shortens during the valve actuation cycle, positive lash is created and the lash adjuster extends, moving the plunger to a higher position at the end of the cycle than at the beginning. Conversely, if the effective length of the valve train increases during the valve actuation cycle, negative lash is created and the lash adjuster contracts, moving the plunger to a lower position at the end of the cycle than at the beginning. The latter condition typically occurs when valve train components lengthen in response to increasing temperature.

As noted previously, commercial lash adjusters of the conventional leakdown type have controlled the escape of fluid (or "leakdown") from the high pressure chamber solely by the fit of the plunger within the body, thus necessitating close clearances therebetween, and selective fitting of the plunger to the body. In an effort to overcome the expense of such selective fitting of the plunger within the body, as well as other associated disadvantages of the prior art, the assignee of the present invention has developed a lash adjuster in which the leakdown flow is past the plunger check valve. This improved lash adjuster is illustrated and described in U.S. Pat No. 5,622,147 for a "HYDRAULIC LASH ADJUSTER", assigned to the assignee of the present invention and incorporated herein by reference.

In lash adjusters of the type disclosed in the above-identified patent, fluid which exits the lash adjuster to lubricate the interface of the ball plunger and the rocker arm must be replenished from a source of low pressure fluid, which is typically the engine oil pump. Therefore, in the conventional lash adjuster, the body has a fluid port machined radially through its wall, with an annular collector groove formed about the inside diameter of the body. Also, the upper plunger member has a radial bore machined through its wall, in a location such that the plunger bore communicates with the collector groove. Fluid then flows inward through the body bore and collector groove, then through the plunger bore, into the low pressure chamber.

Although the fluid flow path described above results in a lash adjuster which performs in a satisfactory manner, the need for the collector groove on the inside diameter of the body, or alternatively on the outside diameter of the plunger, and the radial bore in the upper plunger adds substantially to the overall manufacturing cost of the lash adjuster. The presence of a groove on the body inside diameter is undesirable because the ring seal mounted on the lower plunger must traverse the groove during lash adjuster assembly, and in so doing, the seal may be damaged. In addition, the length of the upper plunger must be sufficient to provide adequate contact area above and below the groove to minimize wear, and must be sufficient above the groove to minimize oil leakage through the clearance between the upper plunger and the body. Within a given body bore depth and a given range of plunger axial motion for a specific engine application, the length of the lower plunger is directly influenced by the length of the upper plunger. The lower plunger length may be sufficiently shortened such that, in the case of a conventional leakdown lash adjuster, the leakdown clearance may need to be tightened to compensate, further increasing manufacturing cost.

BRIEF SUMMARY OF THE INVENTION

Accordingly, it is an object of the present invention to provide an improved hydraulic lash adjuster of the type having both a high pressure chamber and a low pressure chamber, in which the fluid flow path into the low pressure chamber is improved.

It is a related object of the present invention to provide an improved hydraulic lash adjuster which accomplishes the above stated object, while substantially eliminating the opportunity for damage to the ring seal on the lower plunger during assembly of the lash adjuster.

It is another object of the present invention to provide an improved hydraulic lash adjuster which is substantially less expensive to manufacture.

The above and other objects of the invention are accomplished by the provision of a hydraulic lash adjuster for an internal combustion engine, the lash adjuster comprising a body defining a blind first bore formed therein and a fluid port in communication with a source of fluid pressure. A plunger assembly is slidingly received within the blind first bore, and a pressure chamber is defined by the blind first bore and the plunger assembly. A fluid chamber is disposed within the plunger assembly. The plunger assembly defines means providing fluid communication between the pressure chamber and the fluid chamber. A biasing means normally urges the plunger assembly outward of the blind first bore. The plunger assembly includes an upper plunger member having a ball plunger element adapted for engagement with an adjacent surface of a valve train component, and a lower plunger member.

The improved hydraulic lash adjuster is characterized by the upper plunger member defining a lower end portion, and the lower plunger member defining an upper end portion, the lower and upper end portions normally being disposed in engagement with each other. The lower and upper end portions cooperate to define passage means operable to provide fluid communication between the blind bore and the fluid chamber. The blind bore and the upper plunger member cooperate to define a radial clearance therebetween, sufficient to permit fluid flow therethrough, whereby the radial clearance and the passage means comprise substantially the only fluid flow path from the fluid port to the fluid chamber.

DETAILED DESCRIPTION OF THE PREFERRED EMBODIMENT

Figure 1:
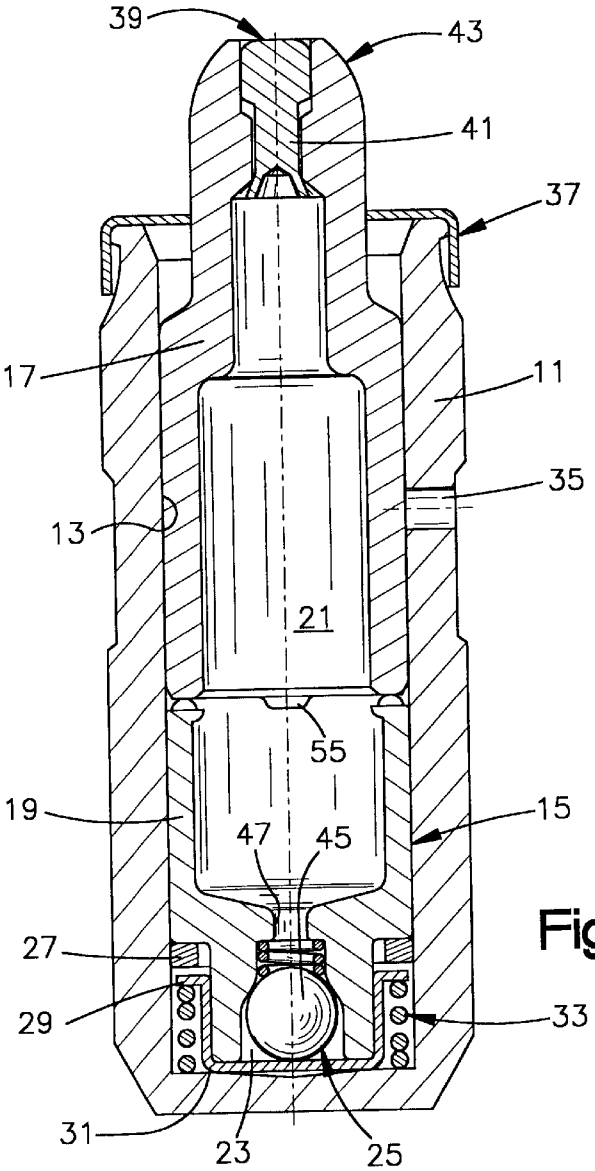
FIG. 1 is an axial cross-section of a lash adjuster made in accordance with the present invention.

Referring now to the drawings, which are not intended to limit the invention, FIG. 1 illustrates a hydraulic lash adjuster made in accordance with the teachings of the present invention.

The lash adjuster of the present invention comprises a body 11 defining a blind bore 13. A plunger assembly, generally designated 15 is slidably disposed within the blind bore 13, and includes an upper plunger element 17, and a lower plunger element 19. The plunger elements 17 and 19 cooperate to define a low pressure chamber 21 (also referred to hereinafter as a "reservoir", or as the "fluid chamber"). The blind bore 13 and the plunger assembly 15 cooperate to define a high pressure chamber 23 (also referred to hereinafter as the "pressure chamber"), which is shown in its minimum volume position in FIG. 1. A check valve assembly, generally designated 25, is operable to permit fluid communication between the reservoir 21 and the pressure chamber 23.

Disposed between the lower plunger element 19 and the bore 13 is a dynamic seal member 27, against which is seated a flange 29 extending radially outwardly from a generally cup-shaped retainer 31. Although the subject embodiment is of the sealed reservoir type, it should be understood that the present invention can also be used advantageously in conventional leakdown type lash adjusters. Preferably, there is an interference fit between the retainer 31 and the reduced diameter portion of the lower plunger element 19. The plunger assembly 15 and the retainer 31 are maintained in the position shown by means of a plunger spring 33.

In the subject embodiment, hydraulic fluid is supplied to the low pressure chamber 21 through a port 35 which opens into the bore 13, and as was mentioned in the BACKGROUND OF THE DISCLOSURE. Normally, the bore 13 would define a collector groove which, in turn would intersect a port defined by the upper plunger element 17, and opening into the low pressure chamber 21. A cap member 37 retains the plunger assembly 15 in a manner well known to those skilled in the art. Metered hydraulic fluid is supplied to the engine rocker arm (not shown) by means of a valve assembly, generally designated 39, which allows a limited flow of fluid outward from the plunger assembly 15, but which also acts as a check valve to prevent the inflow of air in the event of a low pressure or negative pressure condition within the chamber 21. The valve assembly 39, the details of which form no part of the present invention, is preferably made in accordance with the teachings of co-pending application U.S. Ser. No. 880,417, for an "IMPROVED METERING VALVE FOR BALL PLUNGER OR PUSHROD SOCKET", assigned to the assignee of the present invention, and incorporated herein by reference.

The valve assembly 39 is illustrated herein as including a pin 41 (sometimes referred to as a "metering" pin) having outwardly extending portions which can be compressed to snap the pin 41 into place through a port formed in the a ball plunger portion 43 of the upper plunger element 17. Preferably, the outwardly extending portion forms a head near the upper end of the pin 41, and the head is operable to engage a seat and serve as a check valve, so that, whenever fluid pressure is relatively low in the low pressure chamber 21, the check valve seats and prevents an inflow of air. In accordance with the teachings of the above-incorporated U.S. Ser. No. 880,417,the pin 41 defines an axially-extending fluid passage (not shown herein for simplicity), thus providing a metered flow of lubrication fluid from the low pressure chamber 21 to the exterior of the ball plunger 43, whenever pressure within the chamber 21 is sufficient to bias the pin 41 upward to the position shown in FIG. 1.

Although the embodiment illustrated in FIG. 1 is a preferred embodiment, it will be understood by those skilled in the art that various other means, such as a gravity flow or a self-contained supply, can be provided to supply fluid to the low pressure chamber or reservoir 21, and that hydraulic fluid can be provided to the rocker arm by various other means, all within the scope of the present invention.

Referring still to FIG. 1, the check valve assembly 25 comprises a check ball 45 which normally is operable to engage a valve seat defined by a surface formed adjacent a valve opening 47, in a manner well known to those skilled in the art. In the subject embodiment, however, the check valve assembly is made in accordance with the teachings of co-pending application U.S. Ser. No. 792,809, for a "HYDRAULIC LASH ADJUSTER AND BIASED NORMALLY OPEN CHECK VALVE SYSTEM THEREFOR", assigned to the assignee of the present invention, and incorporated herein by reference. In its normal function as a check valve, the check ball 45 will be disposed away from the valve seat when the plunger assembly 15 is moving upward, under the influence of the plunger spring 33, permitting hydraulic fluid to flow from the reservoir 21, through the valve opening 47 into the high pressure chamber 23.

Figure 2:
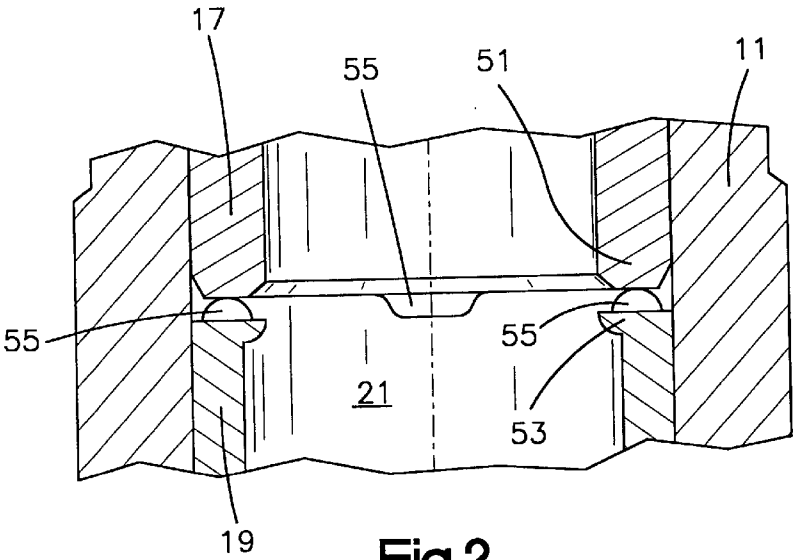
FIG. 2 is an enlarged, fragmentary, axial cross-section, similar to FIG. 1, illustrating a preferred embodiment of the present invention.

Referring now to FIG. 2, in conjunction with FIG. 1, the upper plunger member 17 includes a lower end portion 51, and the lower plunger element 19 includes an upper end portion 53. In accordance with an important aspect of the invention, the lower end portion 51 and the upper end portion 53, which are in engagement with each other during normal operation, cooperate to define a fluid passage means into the low pressure chamber 21. More specifically, and by way of example only, upper end portion 53 of the lower plunger element 19 defines a series of openings or notches 55, thus permitting fluid flow radially inward, through the notches 55, into the chamber 21. Also by way of example only, there are four of the notches 55, evenly spaced about the circumference of the upper end portion 53, it being understood that neither the particular number of openings, nor their arrangement, is an essential feature of the invention.

In accordance with another aspect of the invention, the body 11 does not define the conventional collector groove about its inside diameter, in fluid communication with the port 35. With the present invention, the need for such a collector groove, and the required difficult and expensive machining, is eliminated. It is also conventional for the upper plunger element to have machined therein a radially extending bore, operable to communicate between the collector groove and the low pressure chamber 21, and the invention also eliminates the need for the radial bore in the upper plunger.

In order to carry out the improved fluid flow path of the present invention, there must be a sufficient radial clearance between the inside diameter of the body 11 and the outside diameter of the upper plunger element 17 to permit fluid flow therethrough. Furthermore, the clearance must be such that the amount of fluid flow permitted will keep the low pressure chamber 21 reasonably full of fluid, even as fluid is periodically exiting the lash adjuster, to lubricate the interface of the ball plunger 43 and the rocker arm (not shown).

In the subject embodiment, and by way of example only, the radial clearance between the body 11 and the upper plunger 17 is in the range of about 0.02 mm to about 0.08 mm. It will be appreciated by those skilled in the art that this radial clearance will vary with factors such as the actual size of the lash adjuster, and the viscosity of the fluid to be used. It is believed that those skilled in the art can readily (and without undue experimentation) ascertain the proper radial clearance to achieve the desired operating characteristics.

In operation, with the fluid port 35 in communication with a source of low pressure (not shown), such as the engine oil pump, fluid flows in through the port 35, then downward through the radial clearance between the body 11 and the upper plunger element 17. As the fluid flow reaches the notches 55, it takes the "path of least resistance" and flows radially inward through the notches 55, into the low pressure chamber 21. It is important that the flow path just described comprises substantially the only flow path from the low pressure source to the low pressure chamber 21. Thus, the present invention provides an improved hydraulic lash adjuster having an improved fluid flow path which makes it possible to eliminate at least one machining step in each of the body and upper plunger.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A hydraulic lash adjuster for an internal combustion engine, said lash adjuster comprising a body defining a blind first bore therein and a fluid port in communication with a source of fluid pressure; a plunger assembly slidingly received within said blind first bore; a pressure chamber defined by said blind first bore and said plunger assembly; a fluid chamber disposed within said plunger assembly; said plunger assembly defining means providing fluid communication between said pressure chamber and said fluid chamber; biasing means normally urging said plunger assembly outward of said blind first bore; said plunger assembly including an upper plunger member having a ball plunger element adapted for engagement with an adjacent surface of a valve train component, and a lower plunger member; characterized by:

(a) said upper plunger member defining a lower end portion, and said lower plunger member defining an upper end portion, said lower and upper end portions normally being disposed in engagement with each other;

(b) said lower and upper end portions cooperating to define passage means operable to provide fluid communication between said blind bore and said fluid chamber; and (c) said blind bore and said upper plunger member cooperating to define a radial clearance therebetween, sufficient to permit fluid flow therethrough, wherein said radial clearance and said passage means comprise substantially the only fluid flow path from said fluid port to said fluid chamber.

2. A hydraulic lash adjuster as claimed in claim 1, characterized by seal means disposed between said blind first bore and said plunger assembly, operable to prevent substantially the flow of fluid therebetween.

3. A hydraulic lash adjuster as claimed in claim 1, characterized by one of said upper plunger member and said lower plunger member defining, in its respective end portion, at least one opening permitting fluid communication into said fluid chamber.

4. A hydraulic lash adjuster as claimed in claim 3, characterized by said upper end portion of said lower plunger member defining a plurality of openings.

5. A hydraulic lash adjuster as claimed in claim 1, characterized by said body and said upper plunger element comprising machined members.

* * * * *